US006776667B2

(12) United States Patent
Funatsu et al.

(10) Patent No.: US 6,776,667 B2
(45) Date of Patent: Aug. 17, 2004

(54) MODULAR JACK

(75) Inventors: Akira Funatsu, Tokyo (JP); Toru Watanabe, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/713,200

(22) Filed: Nov. 17, 2003

(65) Prior Publication Data

US 2004/0102100 A1 May 27, 2004

(30) Foreign Application Priority Data

Nov. 19, 2002 (JP) ..... 2002-335127

(51) Int. Cl.[7] ..... H01R 24/00
(52) U.S. Cl. ..... 439/676
(58) Field of Search ..... 439/676, 620, 439/540.1, 76.1

(56) References Cited

U.S. PATENT DOCUMENTS 5,057,035 A * 10/1991 Drewnicki ..... 439/425
5,186,649 A * 2/1993 Fortner et al. ..... 439/460
6,093,060 A * 7/2000 Wiebking et al. ..... 439/676
6,210,235 B1 * 4/2001 Wu ..... 439/676
6,296,527 B1 * 10/2001 Zhang et al. ..... 439/676
6,431,917 B1 * 8/2002 Belopolsky et al. ..... 439/676
6,461,200 B1 * 10/2002 Shi et al. ..... 439/676

FOREIGN PATENT DOCUMENTS

JP 2000-299164 10/2000

* cited by examiner

*Primary Examiner*—Gary Paumen
(74) *Attorney, Agent, or Firm*—Kanesaka & Takeuchi

(57) ABSTRACT

A modular jack (41) in which a modular plug (75) is plugged, comprises a housing body (42) including a cavity (52) at a front side thereof in which the modular plug (75) is plugged and a rear wall (56) having openings (57 and 58) and fixed portions (59 and 60), and a plurality of terminals (43–50) fixed to the fixed portions (59 and 60) and extend to the cavity (52) in a form of cantilevered beams supported by the fixed portions (59 and 60).

5 Claims, 10 Drawing Sheets

MODULAR JACK

BACKGROUND OF THE INVENTION

1. Field of the Invention

This invention relates to a modular jack in which a modular plug is plugged.

2. Description of the Related Art

A modular jack is one of conventional connectors which are used in telephone equipment or local area network (LAN). The modular jack is usually mounted on a circuit board and the modular plug, which connects a plurality of core wires, such as cables, to each other, is plugged in the modular jack.

For example, as shown in FIGS. 13 to 16, Japanese Patent Application Kokai Number 2000-299164 discloses such a conventional modular jack. The modular jack comprises a housing body and eight terminals (the first to eighth terminals 3, 4, 5, 6, 7, 8, 9, and 10) provided in the housing body. The housing body is composed of an insert 11 and a modular jack assembly 12 for receiving the insert 11.

The insert 11 is composed of a rear wall 13 and a top wall 14 extending forwardly from the top of the rear wall 13. A predetermined number of upper grooves 15 are formed on the upper surfaces of the rear and top walls 13 and 14 and a predetermined number of rear grooves 16 are formed on the rear surface of the rear wall 13 such that the rear grooves 16 continues from the upper grooves 15 and extend in a vertical direction.

The respective terminals 3 to 10 are fixed to the rear wall 17 via an extended portion 17 and divided into two groups in accordance with the shapes thereof to reduce the electrical cross-talk. The first group consists of the first, third, fifth, and eighth terminals 3, 5, 7, and 10, and the second group consists of the second, fourth, sixth, and seventh terminals 4, 6, 8, and 9. As shown in FIG. 15(A), the respective terminals 3, 5, 7, and 10 of the first group have a fixed portion 18 fixed to a board 26, a vertical portion 19 extending vertically along the rear groove 16, a horizontal portion 20 extending horizontally along the upper groove 15, and a contact portion 21 folded back obliquely in a lower back direction at the end of the horizontal portion 20. The top of the contact portion 21 is a free end. As shown in FIG. 15(B), the respective terminals 4, 6, 8, and 9 of the second group have a fixed portion 22 fixed to a board 26, a vertical portion 23 extending vertically along the rear groove 16, a horizontal portion 24 extending horizontally along the upper surface of the rear wall 13, and a contact portion 25 curved downwardly from the end of the horizontal portion 24 and then extending obliquely in an upper forward direction. The top end of the contact portion 25 is supported by the front end of the top wall 14.

As shown in FIG. 16, the modular jack assembly 12 is mounted on the circuit board 26 and comprises sixteen receiving cavities 27 and 28 arranged in two-stage at the front side thereof. The insert 11 and the terminals 3 to 10 are arranged in the receiving cavity 28 of the lower stage and other insert and terminals (not shown) are arranged in the receiving cavity of the upper stage. Under this condition, the respective receiving cavities 27 and 28 are provided with plug-in cavities (not shown) in which the modular plugs are plugged.

When the modular plug is plugged in the modular jack, the contact portions 21 and 25 of the terminals 3 to 10 of the first and second groups are brought into contact with terminals (not shown) of the modular plug for electrical connection between the modular jack and plug.

In the conventional modular jack, however, it is required that the contact portions 21 of the terminals 3, 5, 7, and 10 of the first group are bent in the oblique lower back direction from the front end of the top wall 14 after the terminals are fixed to the insert 11. Accordingly, long-time assembly work and lengthy terminals are required, which makes it difficult to reduce the assembling and material costs. Also, a sufficient height of the housing body is necessary for bending the contact portions 21 in the oblique lower back direction, which makes it difficult to minimize the size of the housing body in the heightwise direction and the size of the modular jack.

In addition, since the housing body is composed of the insert 11 and modular jack assembly 12, which incorporate the respective terminals 3 to 10 into the housing body, it is difficult to reduce the number of parts and the manufacturing cost cannot be reduced.

BRIEF SUMMARY OF THE INVENTION

Accordingly, it is an object of this invention to provide a modular jack, which makes it possible to reduce the assembling and material costs, minimize the size of the product, and reduce the number of used parts.

According to an aspect of the invention, a modular jack in which a modular plug is plugged, comprises a housing body including a cavity at a front side thereof in which the modular plug is plugged and a rear wall having openings and fixed portions, and a plurality of terminals fixed to the fixed portions and extend to the cavity in a form of cantilevered beams supported by the fixed portions, wherein the terminals are inserted into the openings to be fixed to the fixed portions.

It is preferable that the fixed portions include first and second fixed portions spaced from each other in a heightwise direction of the modular jack by a predetermined distance, wherein the first and second fixed portions are arranged alternately.

According to another aspect of the invention, the terminals include first terminals which are fixed to the first fixed portions and second terminals which are fixed to the second fixed portions, wherein the respective first terminals have first forwardly inclined contact portions and the second respective terminals have second forwardly inclined contact portions, wherein the first and second inclined contact portions have angles of inclinations which are different from each other.

It is preferable that the first and second inclined contact portions have first and second curved sections, respectively, at front ends thereof, wherein the first and second curved sections are disposed at different positions from each other in a back-and-forth direction.

Also, it is preferable that the housing has a plurality of control portions in a bottom wall thereof at positions corresponding to those of the terminals so that the terminals abut against the control portions to prevent excessive flexure of the terminals.

With the above-described structure, when the respective terminals are inserted into the openings in the rear wall of the housing body, they are firmly fixed to the housing body and extend to the plugging cavity in the form of cantilevered beams supported by the fixed portions.

DESCRIPTION OF THE PREFERRED EMBODIMENT

Figure 1:
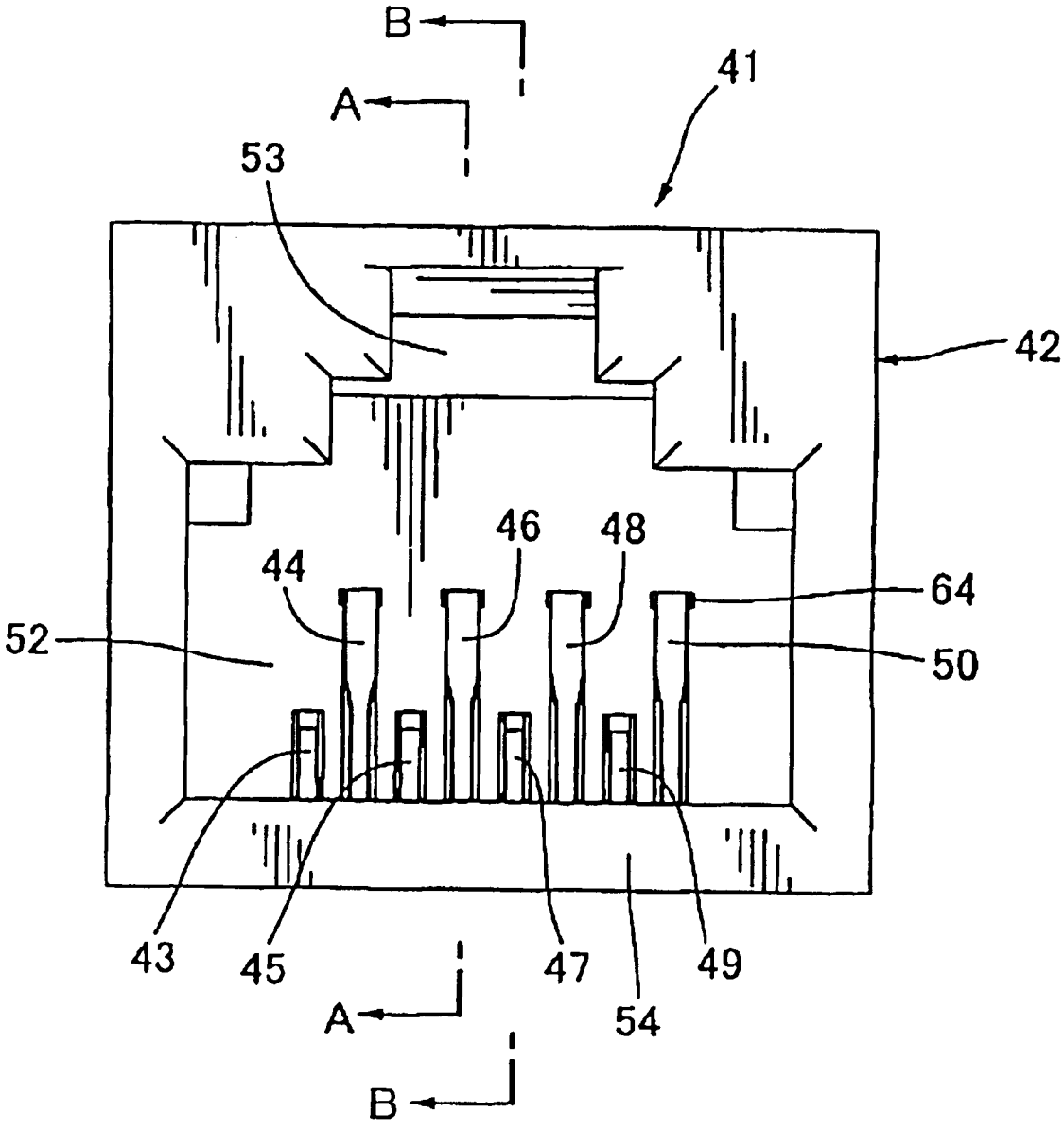
FIG. 1 is a front view of a modular jack according to an embodiment of the present invention.
Figure 2:
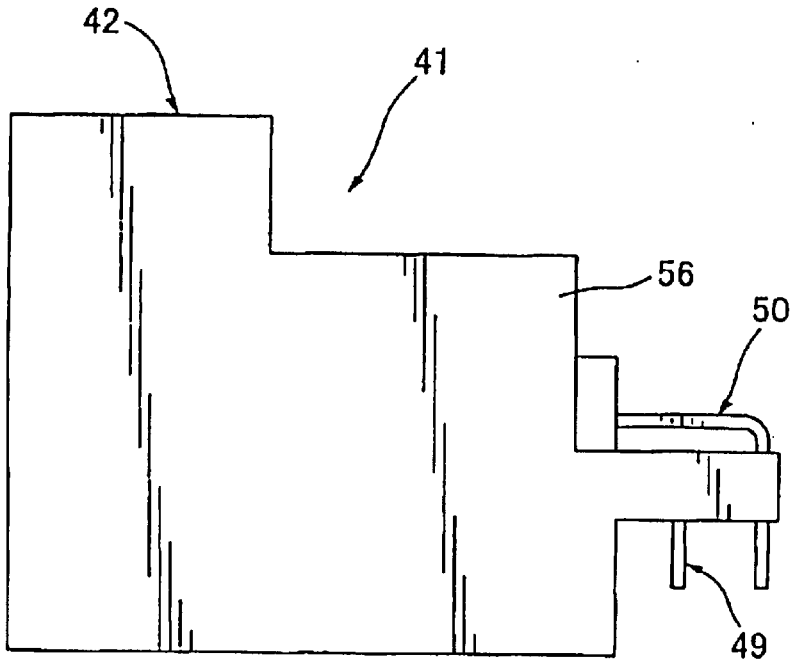
FIG. 2 is a side view of the modular jack of FIG. 1.
Figure 3:
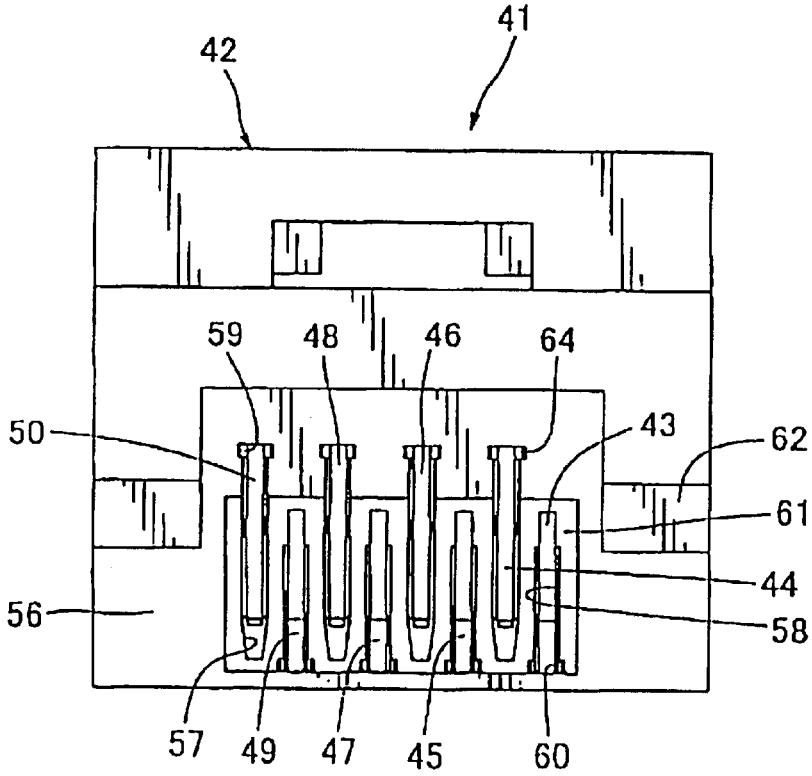
FIG. 3 is a rear view of the modular jack of FIG. 1.

The invention will be described in detail with reference to the accompanying drawings.

FIGS. 1–7 show a modular jack 41 for high-speed signals according to an embodiment of the invention. The modular jack 41 comprises a housing body 42 and a predetermined number (eight in the drawings) of terminals, the first to eighth terminals 43, 44, 45, 46, 47, 48, 49, and 50, and is mountable on a board 51.

The housing body 42 is provided with a plugging cavity 52 in the front side thereof so that a modular plug 75 (FIGS. 6 and 7) can be plugged in the cavity 52. A lock member receiving portion 53 is provided in the upper side of the cavity 52 and eight grooves 55 extending long in a back-and-forth direction are provided on the inner surface of a bottom wall 54 of the housing body 42. First and second terminal slits 57 and 58 having vertically long shapes are provided in the rear wall 56 of the housing body 42. The first and second slits 57 and 58 are composed of four grooves, respectively, which are arranged alternately. First and second extended fixed portions 59 and 60 are provided at the upper side of the first terminal slits 57 and the lower side of the second terminal slits 58, respectively. It is preferable that the first fixed portion 59 is disposed above the upper side of the second terminal slits 58 and the second fixed portion 60 is disposed below the lower side of the first terminal slits 57. By this arrangement, there is provided a sufficient thickness of the housing body 42 between the respective first terminal slits 59 and the respective second fixed portions 60 so that high strength of the housing body 42 is obtained. A cavity 61 is provided in the rear wall 56 such that the cavity 61 surrounds the four second terminal slits 58 and a pair of board fixed portions 62 extend rearwardly from both sides of the rear wall 56 so that the housing body 42 can be fixed to the board 51 via the board fixed portions 62.

Figure 4:
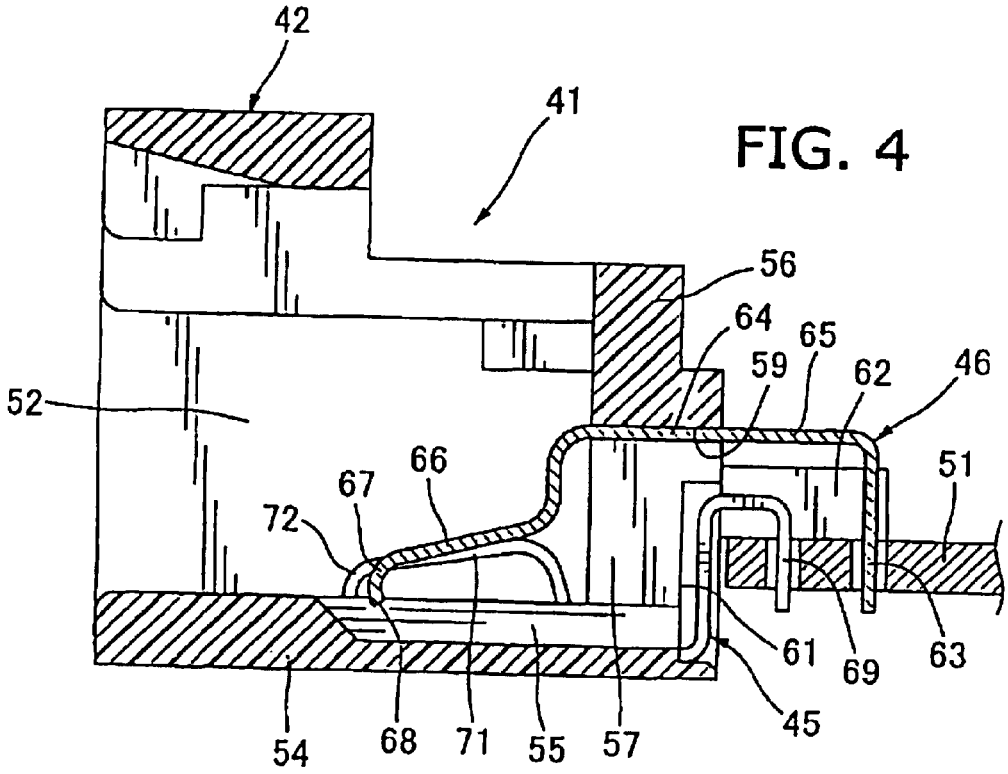
FIG. 4 is a sectional view of FIG. 1 taken along the line A—A.

The terminals 43 to 50 are divided into two groups in accordance with the shapes thereof. The first group consists of the second, fourth, sixth, and eighth terminals 44, 46, 48, and 50, and the second group consists of the first, third, fifth, and seventh terminals 43, 45, 47, and 49. As best shown in FIG. 4, each of the terminals 44, 46, 48, and 50 of the first group has a vertical portion 63 of which lower end is fixed to a board 51, a horizontal portion 65 having an extended portion 64 at the front end thereof press-fitted into the first fixed portion 59, a contact portion 66 extending downwardly along the inner surface of the rear wall 56 and then in an oblique lower forward direction, and a curved portion 67 curved outwardly from the front end f the contact portion 66. The distance between the lowermost end 68 of the curved portion 67 and the extended portion 64 is made smaller that the height of the first terminal slit 57 so that each terminal can be inserted into the first terminal slit 57 from the rear side of the housing body 42.

Figure 5:
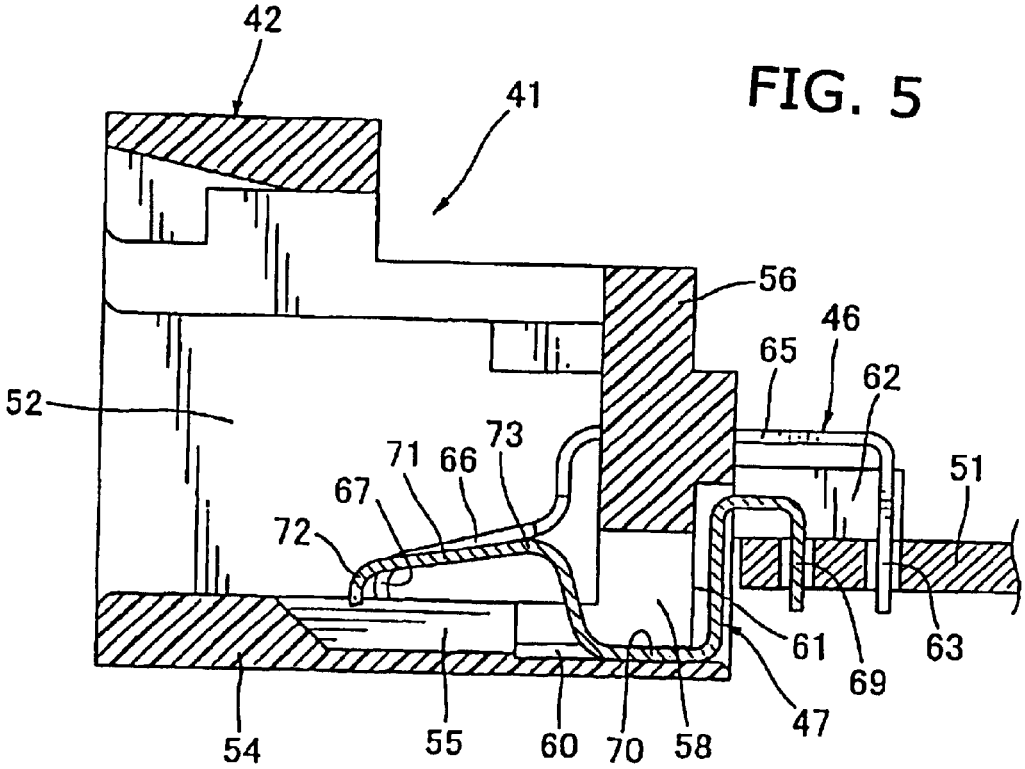
FIG. 5 is a sectional view of FIG. 1 taken along the line B—B.

As best shown in FIG. 5, each of the terminals 43, 45, 47, and 49 of the second group has a vertical portion 69 of which lower end is fixed to a board 51, an extended portion 70 extending downwardly from the upper end of the vertical portion 69 along the cavity 61 and press-fitted into the second fixed portion 60, a contact portion 71 extending upwardly along the inner surface of the rear wall 56 and then in an oblique lower forward direction, and a curved portion 72 curved outwardly from the front end f the contact portion 71. The distance between the extended portion 70 and the uppermost end 73 of the contact portion 71 is made smaller that the height of the second terminal slit 58 so that each terminal can be inserted into the second terminal slit 58 from the rear side of the housing body 42. It is preferable that the angle of inclination of the contact portions 71 of the terminals 43, 45, 47, and 49 of the second group is made different from that of the contact portions 66 of the terminals 44, 46, 48, and 50 of the first group. Also, it is preferable that the position in the back-and-fourth direction, of the curved portion 72 of the terminals 43, 45, 47, and 49 of the second group is made different from that of the curved portions 67 of the terminals 44, 46, 48, and 50 of the first group.

As describe above, the terminals 44, 46, 48, and 50 of the first group is fixed (press-fitted) to the housing body 42 at the upper position of the first terminal slits 57 and the terminals 43, 45, 47, and 49 of the second group is fixed (press-fitted) to the housing body 42 at the lower position of the second terminal slits 58 so that the distance between the terminals of the first and second groups is made large and there is almost no overlapped portion of the terminals of the first and second groups when viewed from side. Also, the top ends of the terminals are made free ends and the length of the terminals is made short so that the transmission path can be made short. Consequently, the cross-talk between the adjacent terminals is reduced so that the modular jack readily corresponds to high-speed signals.

In order to fix the terminals to the housing body 42, the terminals 44, 46, 48, and 50 of the first group are inserted into the first terminal slits 57 and the terminals 43, 45, 47, and 49 of the second group are inserted into the second terminal slits 58 from the rear side of the housing body 42. The extended portions 64 and 70 are press-fitted to the first and second fixed portions 59 and 60, respectively so that the respective terminals 43 to 50 extend to the plugging cavity 52, cantilevered with the support by the first and second fixed portion 59 and 60. Thus, the respective terminals are firmly held in the housing body 42 and the respective curved portions 67 and 72 of the terminals 43 to 50 are positioned above the long grooves 55.

The terminals 43 to 50 can be easily installed to the housing body 42 by inserting them into the first and second fixed portions 59 and 60 from the rear side of the housing body 42 and the bending work of the terminals is not necessary after the insertion so that the assembly of the terminals can be made simple. The terminals 43 to 50 are cantilevered by the first and second fixed portions 59 and 60 and extend forwardly so that the terminals 43–50 is short, the transmission path is also short, and the material cost can be reduced. In addition, since respective contact portions 66 and 71 have no folded portions, the height of the housing body 42 can be made small, which enables the miniaturization of the modular jack. Moreover, since the housing body 42 is composed of only one part, the manufacturing cost can be reduced.

The operation of plugging the modular plug 75 in the modular jack 41 will be described.

Figure 6:
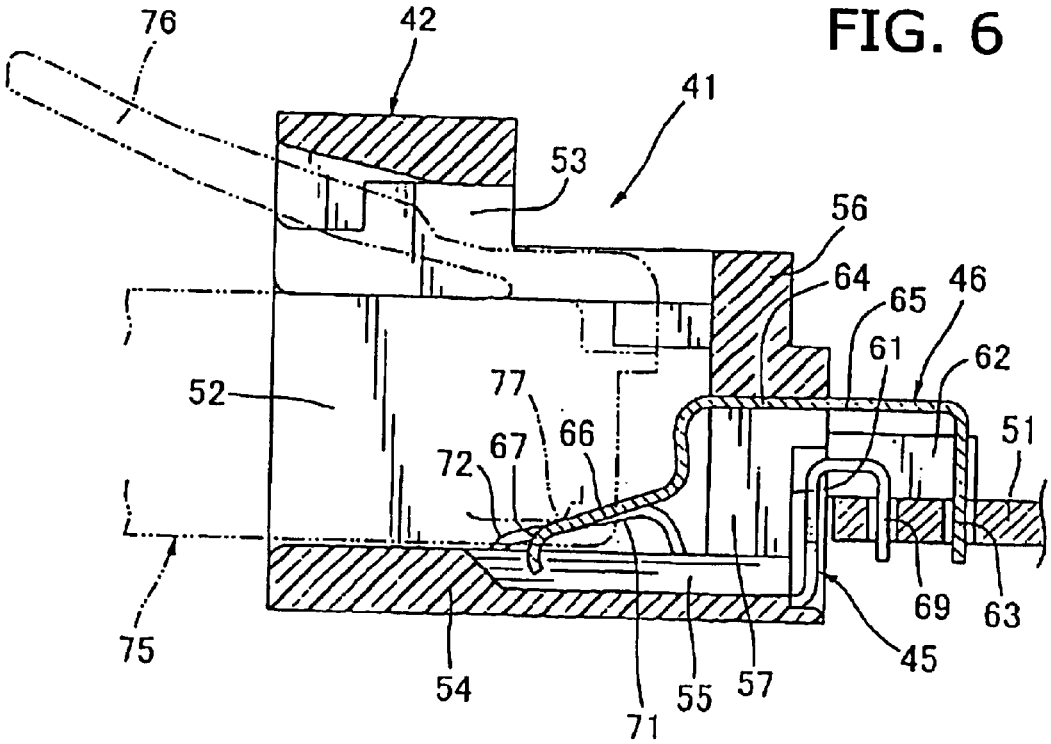
FIGS. 6–7 are sectional views of the modular jack according to the embodiment of the invention, showing operation of the modular jack.
Figure 7:
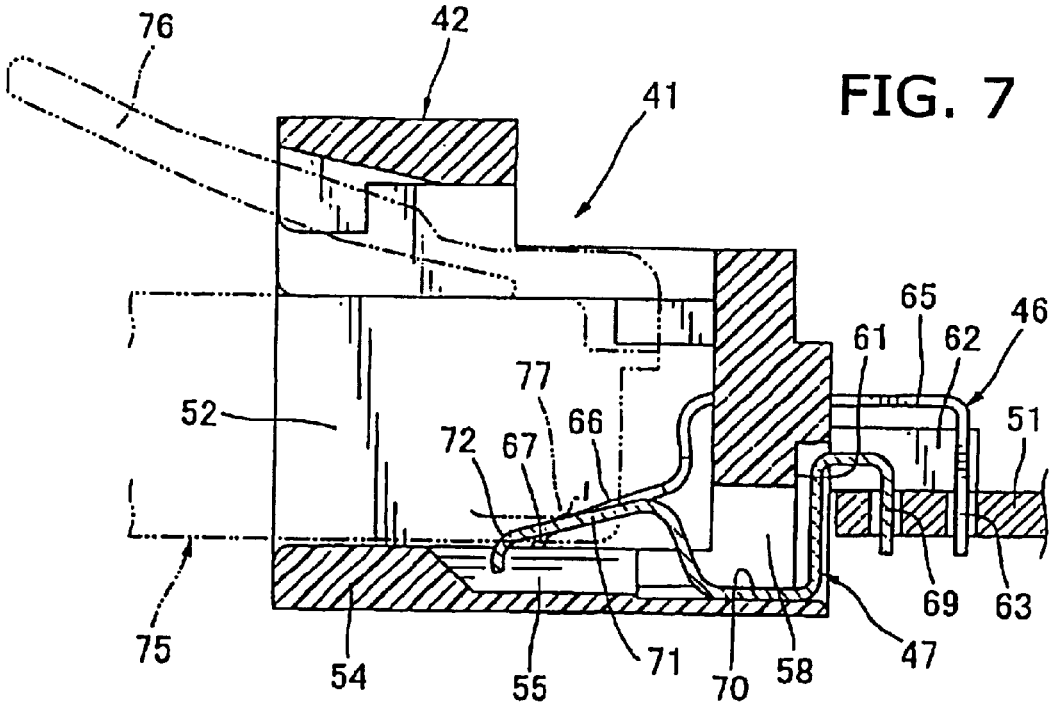

In FIGS. 6 and 7, when the modular plug 75 is plugged in the cavity 52 such that the locking member 76 of the modular plug 75 fits the locking member receiving portion 53 of the modular jack 41, the terminals 77 of the modular plug 75 abut against the respective contact portions 66 and 71 of the terminals 43–50 of the modular jack 41. At this point, the respective contact portions 66 and 71 are positioned in the terminal arrangement grooves (not shown) provided at the top end of the modular plug 75. When the terminals 77 of the modular plug 75 abut against the contact portions 66 and 71, the contact portions 66 and 71 flex downwardly and the front ends thereof are accommodated in the long grooves 55 so that the terminals 77 of the modular plug 75 and the terminals 43–50 of the modular jack 41 are brought into contact with each other at a predetermined pressure, thus electrically connecting the modular plug and jack 75 and 41. Since the curved portions 67 and 72 are provided in the respective terminals 43–50, the plugging operation between the modular plug and jack 75 and 41 is performed smoothly.

Figure 8:
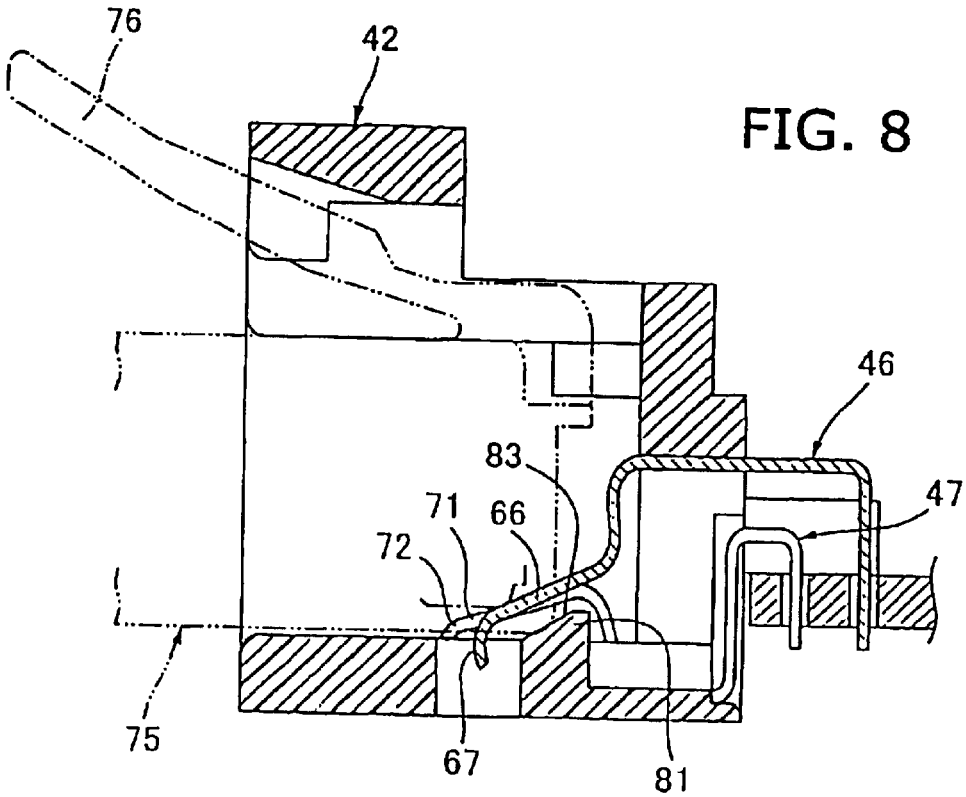
FIG. 8 is a sectional view of a modular jack according to another embodiment of the invention.
Figure 9:
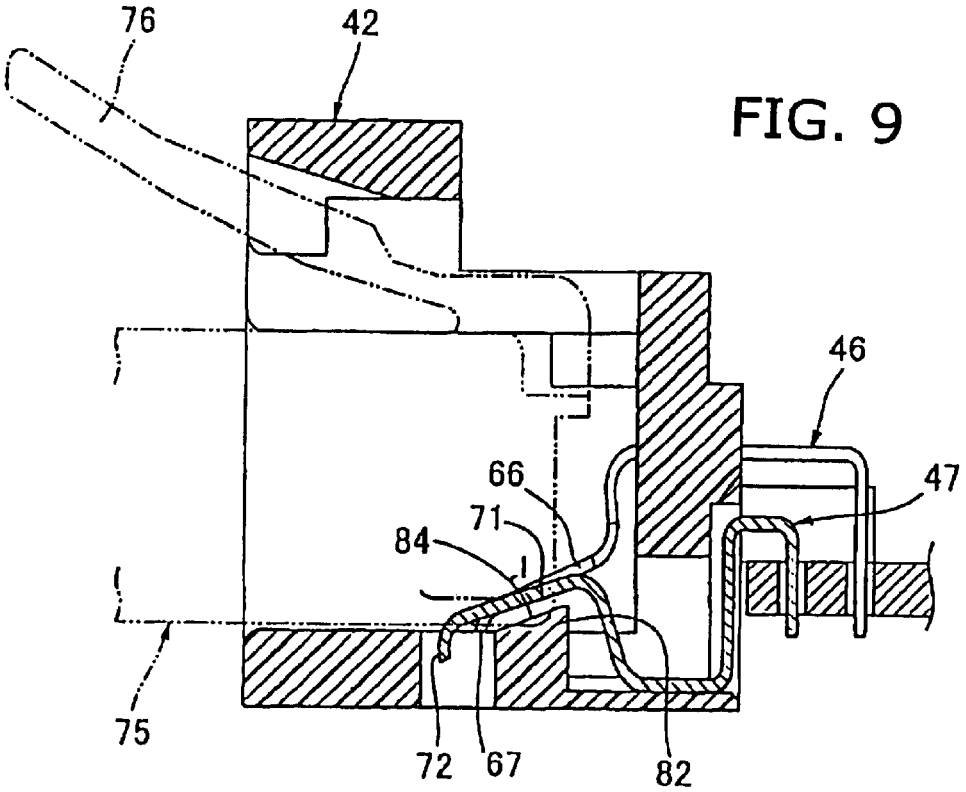
FIG. 9 is a sectional view of a modular jack according to still another embodiment of the invention.

As shown in FIGS. 8 and 9, a first control portions 81 (FIG. 8) and a second control portions 82 (FIG. 9) can be provided in the inner surface of the bottom wall 54 of the housing body 42. The first and second control portions 81 and 82 are provided at positions corresponding to those of the respective contact portions 66 and 71 of terminals of the first and second groups and formed in the form of comb teeth so that they do not interfere with the terminal arrangement grooves of the modular plug 75. Inclined faces 83 and 84 having inclinations corresponding to the contact portions 66 and 71, respectively, are provided on the upper sides of the first and second control portions 81 and 82 such that when the modular plug 75 is plugged in the modular jack 41 (in the condition of FIGS. 8 and 9), the contact portions 66 and 71 can flex toward the first and second control portions 81 and 82, respectively, until they come close to or abut against the first and second control portions 81 and 82. The bottom wall 54 ahead of the first and second control portions 81 and 82 are opened due to reasons for manufacture. In this case, when a deformed or different kind of modular plug is attempted to be plugged in the modular jack 41, the contact portions 66 and 71 of the modular jack 41 are not properly positioned at the terminal arrangement grooves of the modular plug and unnaturally strong force is exerted on the respective contact portion 66 and 71 by the pressure from the top end of the modular plug. Even if a foreign body or different kind of connector is inserted into the modular jack 41 and unreasonable force is exerted on the contact portions 66 an 71, the contact portions 66 and 71 are not broken because they abut against the first and second control portions 81 and 82 and do not flex any more. In addition, as the modular jack 41 is miniaturized, the resilient force of the terminals is weaken and the terminals are prone to be broken. However, even in that case, the first and second control portions 81 and 82 prevent the terminals from being broken.

Figure 10:
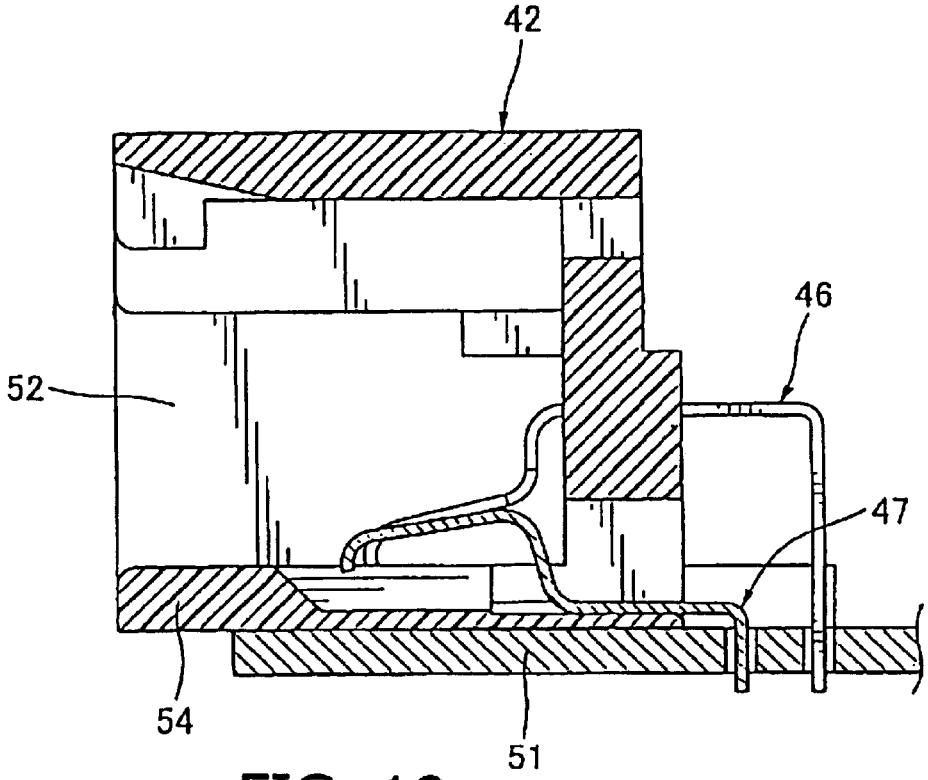
FIG. 10 is a sectional view of a modular jack according to yet another embodiment of the invention.
Figure 11:
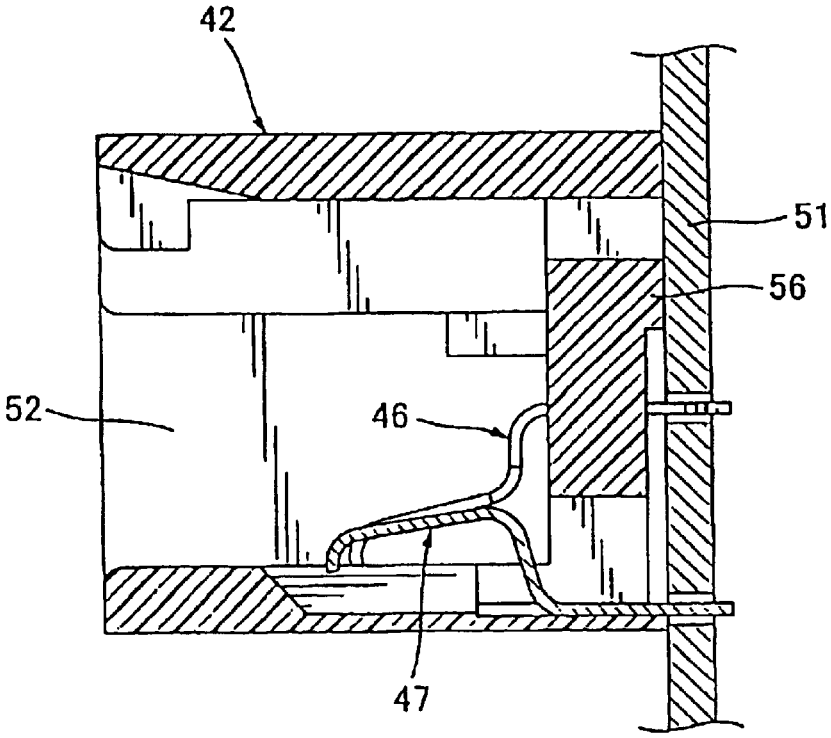
FIG. 11 is a sectional view of a modular jack according to another embodiment of the invention.
Figure 12:
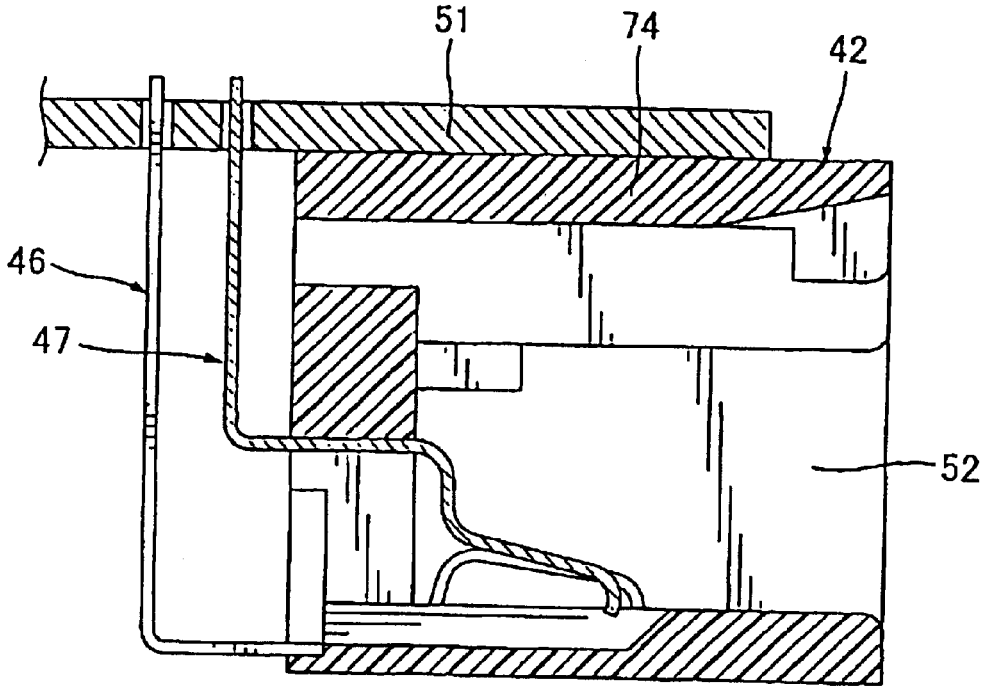
FIG. 12 is a sectional view of a modular jack according to still another embodiment of the invention.
Figure 13:
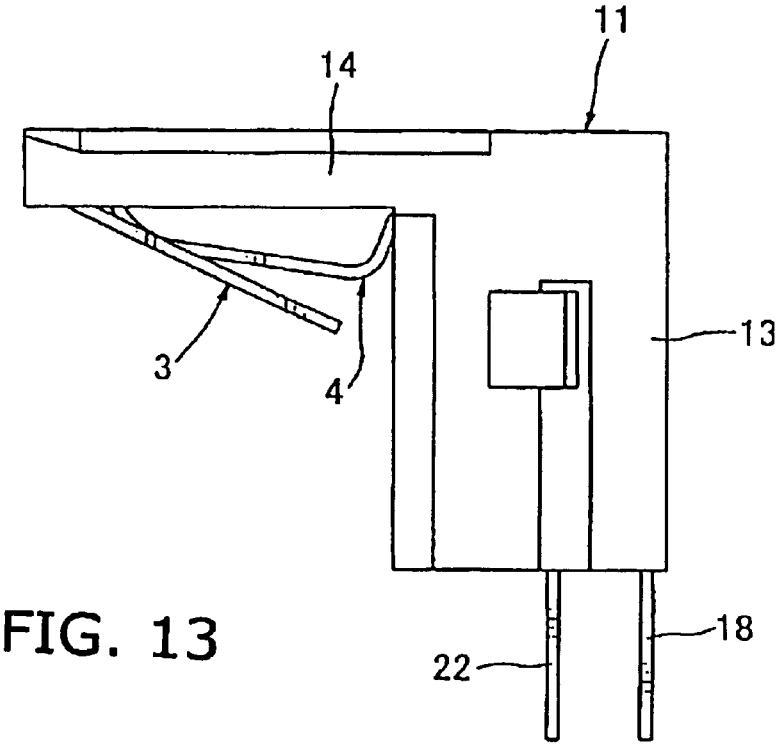
FIG. 13 is a side view of a conventional modular jack.
Figure 14:
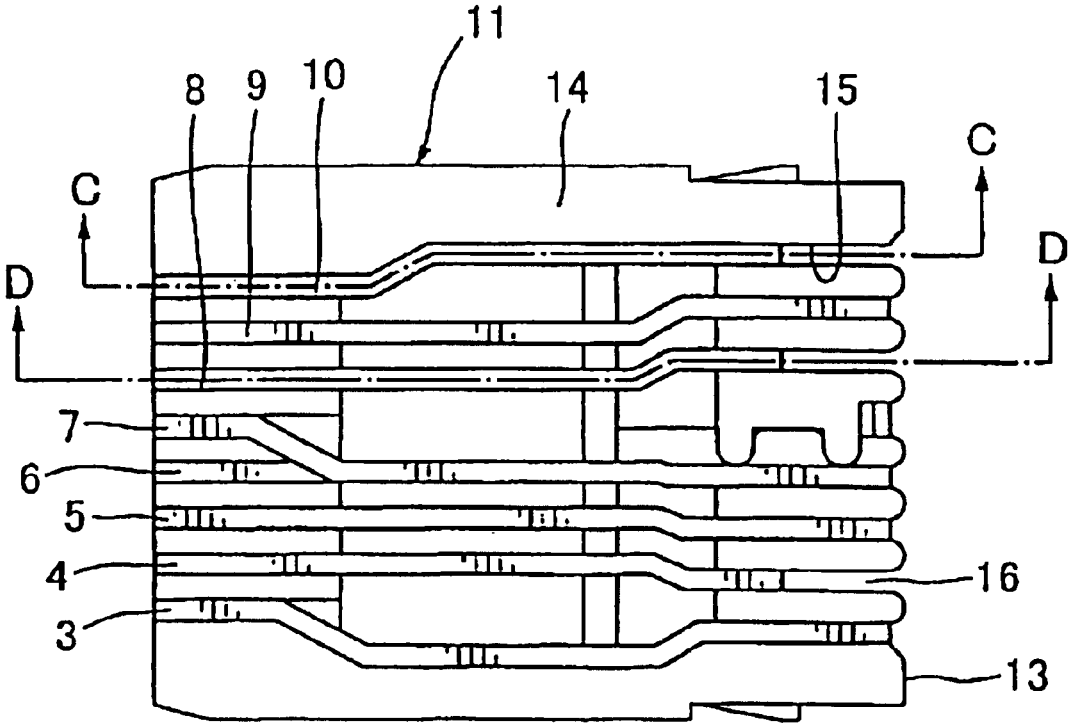
FIG. 14 is a top view of the conventional modular jack.
Figure 15A:
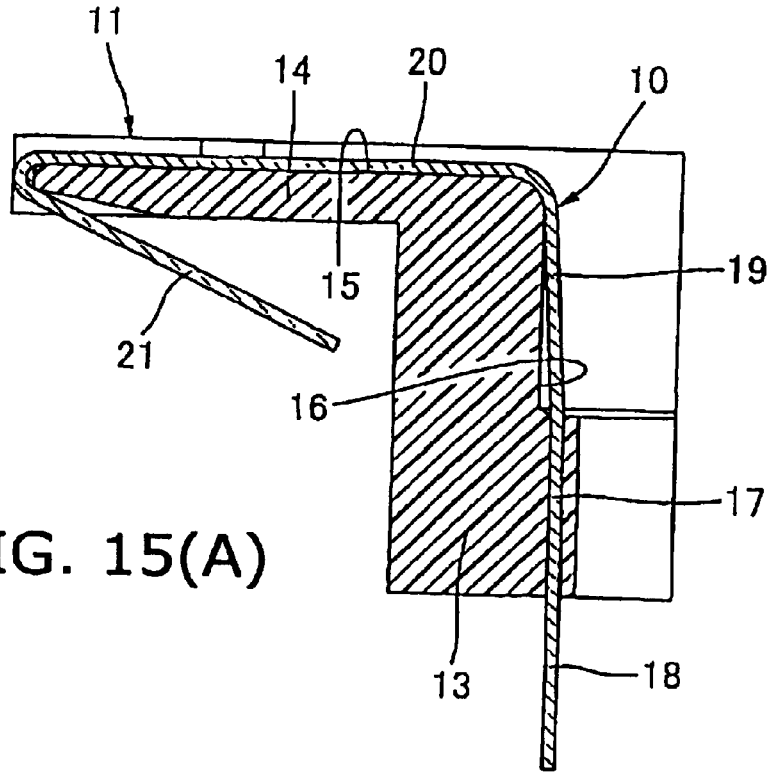
FIGS. 15(A) and 15(B) are sectional views of FIG. 14 taken along the lines C—C and D—D, respectively.
Figure 15B:
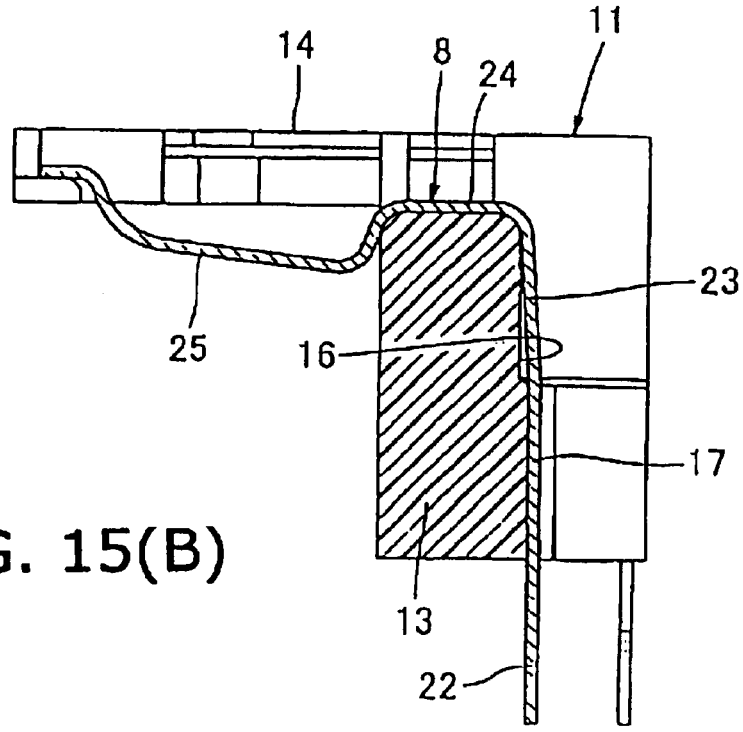
Figure 16:
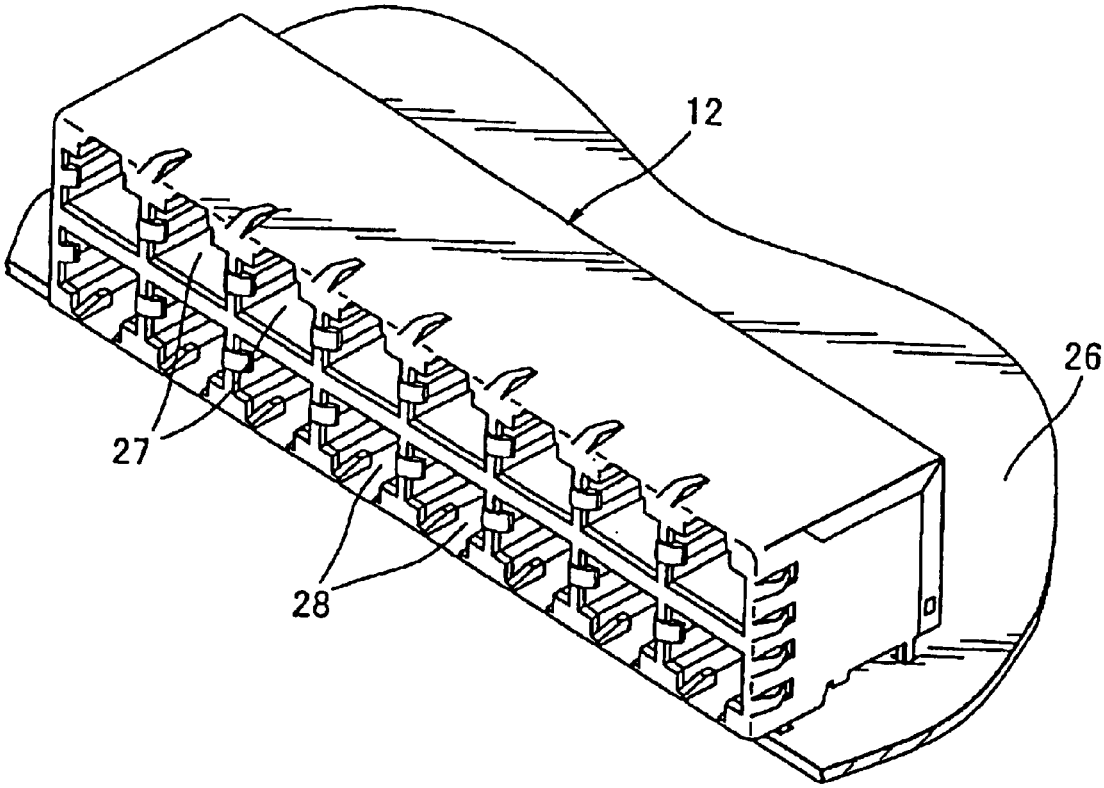
FIG. 16 is a perspective view of the conventional modular jack.

In the above embodiments, the modular jack 41 is mounted on the board 51 via the board fixed portion 62. However, in FIGS. 10–12, the modular jack 41 is mounted on the board 51 via the bottom wall 54, rear wall 56, and top wall 74 of the housing body 42, respectively.

In the above embodiments, the modular jack 41 corresponds to high-speed signals. However, the invention is applicable to a modular jack for low-speed signals, such as telephone line. In this case, all terminals 43–50 may have the same shape so that the manufacturing cost of the terminals is further reduced.

When the modular jack is used for high-speed signals, the terminals 43–50 may be divided into three groups instead of two groups in accordance with the shape thereof. Also, the shapes of the respective terminals 43–50 are not limited to the above-mentioned shapes.

The shapes of the first and second terminal slits 57 and 58 may be different as far as it can fix the terminals. For example, it may be the form of a groove after removing the bottom wall 54.

As fully described above, the terminals can be easily fixed to the fixed portions of the rear wall by inserting them into the cavities provided in the rear walls, the terminals extend to the plugging cavity, cantilevered by the fixed portions, and the housing body is composed of one part so that it is possible to simplify the assembly work, reduce the cross-talk, reduce the number of parts, and reduce the manufacturing cost.

What is claimed is:

1. A modular jack in which a modular plug is plugged, comprising:

a one piece housing body including a cavity at a front side thereof in which said modular plug is plugged and a rear wall having openings and fixed portions; and a plurality of pre formed terminals fixed to said fixed portions and extend to said cavity in a form of cantilevered beams supported by said fixed portions, wherein said terminals are inserted from the rear into said openings to be fixed to said fixed portions.

2. The modular jack according to claim 1, wherein said fixed portions include first and second fixed portions spaced from each other in a heightwise direction of said modular jack by a predetermined distance, wherein said first and second fixed portions are arranged alternately.

3. The modular jack according to claim 2, wherein said terminals include first terminals which are fixed to said first fixed portions and second terminals which are fixed to said second fixed portions, wherein said respective first terminals have first forwardly inclined contact portions and said second respective terminals have second forwardly inclined contact portions, said first and second inclined contact portions having angles of inclinations which are different from each other.

4. The modular jack according to claim 3, wherein said first and second inclined contact portions have first and second curved sections, respectively, at front ends thereof, said first and second curved sections being disposed at different positions from each other in a back-and-forth direction.

5. The modular jack according to claim 1, wherein said housing has a plurality of control portions in a bottom wall thereof at positions corresponding to those of said terminals so that said terminals abut against said control portions to prevent excessive flexure of said terminals.

* * * * *